US007516840B2

(12) United States Patent
Troha et al.

(10) Patent No.: US 7,516,840 B2
(45) Date of Patent: Apr. 14, 2009

(54) BRASSIERE TRAVEL CARRIER PROTECTOR AND METHOD

(76) Inventors: Alexis Lynn Troha, 1294 Waters Edge Dr., Centerville, OH (US) 45458; Frank Vincent Troha, 1294 Waters Edge Dr., Centerville, OH (US) 45458; Gwendolyn Leigh Troha, 1294 Waters Edge Dr., Centerville, OH (US) 45458; Leigh Adrienne Troha, 9296 Heritage Glenn Dr., Miamisburg, OH (US) 45342

( * ) Notice: Subject to any disclaimer, the term of this patent is extended or adjusted under 35 U.S.C. 154(b) by 616 days.

(21) Appl. No.: 10/971,291

(22) Filed: Oct. 22, 2004

(65) Prior Publication Data

US 2006/0086740 A1 Apr. 27, 2006

(51) Int. Cl.
*B65D 85/18* (2006.01)

(52) U.S. Cl. ..... 206/278; 206/279

(58) Field of Classification Search ..... 206/278, 206/740, 741, 279

See application file for complete search history.

(56) References Cited

U.S. PATENT DOCUMENTS

| | | | | | |
|---|---|---|---|---|---|
| 1,324,669 | A | * | 12/1919 | Harris | 206/45.27 |
| 1,444,350 | A | * | 2/1923 | Levy | 206/8 |
| 1,968,579 | A | * | 7/1934 | Wheary | 206/289 |
| 2,282,483 | A | * | 5/1942 | Krause | 220/801 |
| 2,384,332 | A | * | 9/1945 | Nicholas | 223/85 |
| 3,539,089 | A | * | 11/1970 | Osberg | 229/120.12 |
| 3,730,309 | A | * | 5/1973 | Hamann et al. | 190/127 |
| 5,002,183 | A | * | 3/1991 | Okano | 206/287 |
| 5,556,013 | A | | 9/1996 | Mayer | |
| 5,829,083 | A | | 11/1998 | Sutton | |
| 5,988,476 | A | * | 11/1999 | Olerio | 224/630 |
| 6,742,683 | B1 | | 6/2004 | Phan | |
| 6,761,291 | B2 | * | 7/2004 | Moskovitz et al. | 223/84 |

FOREIGN PATENT DOCUMENTS

| | | | |
|---|---|---|---|
| GB | 2142527 | * | 1/1985 |
| JP | 2003-237865 | * | 8/2003 |

OTHER PUBLICATIONS

Bra Protector at the Bra Superstore. Jun. 16, 2004. <http://www.underworks.com/bras/braprotector.html>.

Bra Box—Clear Drawer Organizer—Set of 2. Jun. 16, 2004. <http://www.organize-everything.com/braboxcleard.html>.

* cited by examiner

*Primary Examiner*—Tri M Mai
(74) *Attorney, Agent, or Firm*—Jacox, Meckstroth & Jenkins

(57) ABSTRACT

The invention relates to a brassiere travel and storage system and method to facilitate storing a plurality of padded brassieres such that the cups of the brassieres do not degenerate and/ or become crushed during storage, such as when a person travels. A container that is capable of situating and positioning the one or a plurality of brassieres in a predetermined position, such as an angled position, so that the brassieres or at least a portion of them can be viewed for identification and selection by a user. The storage system and method is adapted to be received in a suitcase an is capable of protecting the plurality of brassieres stored therein so that they do not become crushed or deformed from storage. The container is also capable of receiving undergarments, bra straps and other items in the storage areas provided in the interior of the container.

30 Claims, 5 Drawing Sheets

32a
32
33
38
10
36
34
12b
12d
12
12a
40
θ
12c
14b
14
14a
76
74
30
24
68
20b
22
20c
72
70
19
26
66
28
20a
20d
20

BRASSIERE TRAVEL CARRIER PROTECTOR AND METHOD

BACKGROUND OF THE INVENTION

This invention relates to a brassiere travel carrier protector system and method for carrying a plurality of brassieres in a manner that will prevent the brassieres from becoming crushed, deformed or distorted when the brassieres are stored, such as during travel.

During storage or travel, it is not uncommon that a brassiere becomes distorted when the cups of the brassiere are exposed to external pressures or are crushed, which causes the configuration of the cups to degenerate. When the brassieres are subsequently worn, for example underneath a thin evening gown or dress, the deformations in the brassiere and the cups can become very unattractive for the user.

U.S. Pat. Nos. 5,829,083, 5,556,013, 6,742,683 disclose various systems and methods for washing, drying and/or storing brassieres. Moreover, Japanese application number 2002-039818 published Aug. 27, 2003 as JP 2003-237865 discloses a brassiere showcase also serving as a brassiere storage container for storing one or more brassieres as shown in the reference One of the problems with the prior art storage systems and methods is that they do not enable a user to store a plurality of brassieres in a manner that prevents distortion to the cups and that would, for example, simultaneously enable a user to view one or more of the brassieres or portions thereof so that the user could identify and select a desired brassiere for use.

There is, therefore, a need for providing an improved system and method for storing brassieres that facilitates reducing or even eliminating the degeneration of the cups of the brassieres.

SUMMARY OF THE INVENTION

In one aspect, this invention comprises a brassiere travel system to facilitate preventing distortion of a plurality of padded brassieres each having a plurality of cups, the system comprising: a container comprising a support for supporting the plurality of cups to facilitate preventing distortion of the plurality of brassieres, the support further supporting at least a portion of each of the brassieres to enable a user to view the at least a portion of the plurality of padded brassieres.

In another aspect, this invention comprises the brassiere travel system wherein the semispherical areas for a first one of the plurality of interchangeable supports have a first predetermined cup size, the pair of semispherical areas for at least one other of the plurality of interchangeable supports defining a second predetermined cup size, the first predetermined cup size being different from the second predetermined cup size.

In still another aspect, this invention comprises a method for storing at least one brassiere such that the pads in the cups of at least one brassiere do not become distorted, the method comprising the steps of: providing a container having a support comprising a plurality of semispherical portions situated at a predetermined position to permit viewing of at least a portion of each of the at least one brassiere, enabling a user to situate the at least one brassiere on the plurality of spherical portions, the plurality of semispherical portions being made of a material that prevents the cups from becoming distorted during travel.

An object of one embodiment is to provide an improved system for storing brassieres, especially during travel.

Another object of another embodiment is to provide a system and method for storing brassieres in a manner that enables a user to identify and select one or more brassieres and simultaneously providing a system and method for storing the brassieres such that the cups do not become crushed or deformed.

While the form of apparatus herein described constitute preferred embodiments of this invention, it is to be understood that the invention is not limited to this precise form of apparatus and that changes may be made therein without departing from the scope of the invention which is defined in the appended claims.

DETAILED DESCRIPTION OF AN EXEMPLARY EMBODIMENT

In the following detailed description, for purposes of explanation and not limitation, example embodiment(s) disclosing specific details are set forth in order to provide a thorough understanding of the present invention. However, it will be apparent to one having ordinary skill in the art having had the benefit of the present disclosure, that the present invention may be practiced in other embodiments that depart from the specific details disclosed herein. Moreover, descriptions of well-known apparati and methods may be omitted so as to not obscure the description of the present invention. Such methods and apparati are clearly within contemplation of the inventors in carrying out the example in embodiments. Whenever possible, like numerals refer to like features throughout.

Figure 2:
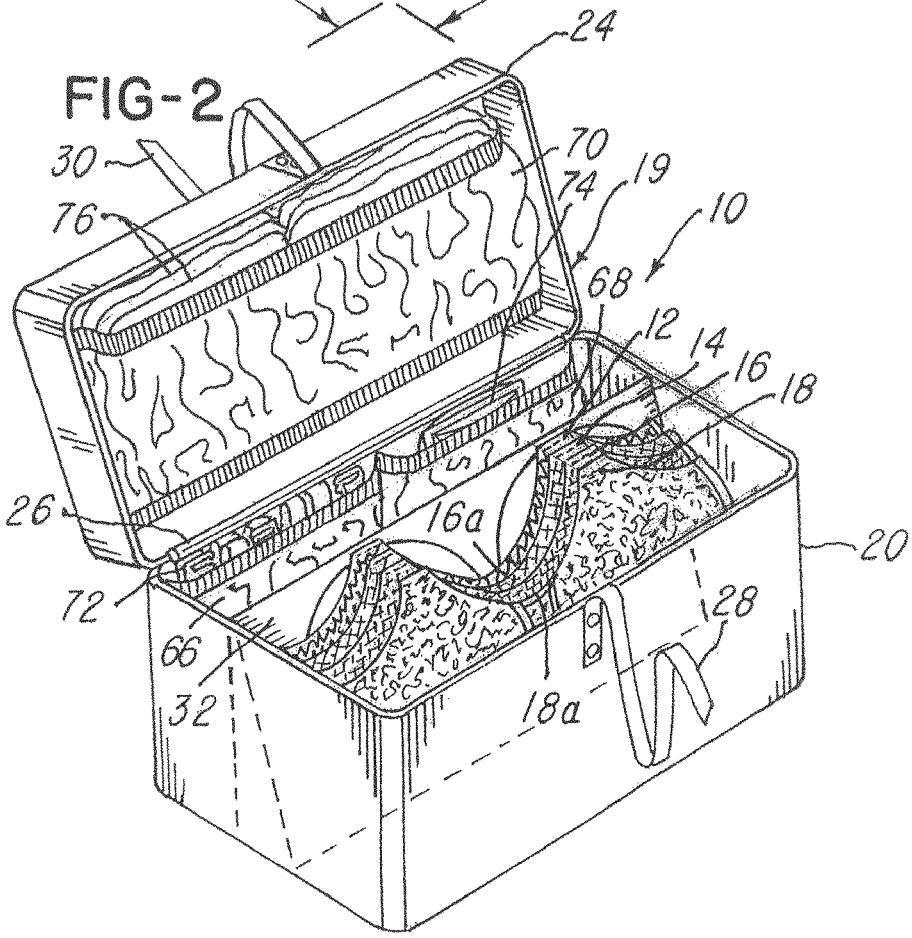
FIG. 2 is a perspective view with the lid open showing the contents of the brassieres situated in an angled position such that at least a portion of each brassiere is visible to the user.
Figure 3:
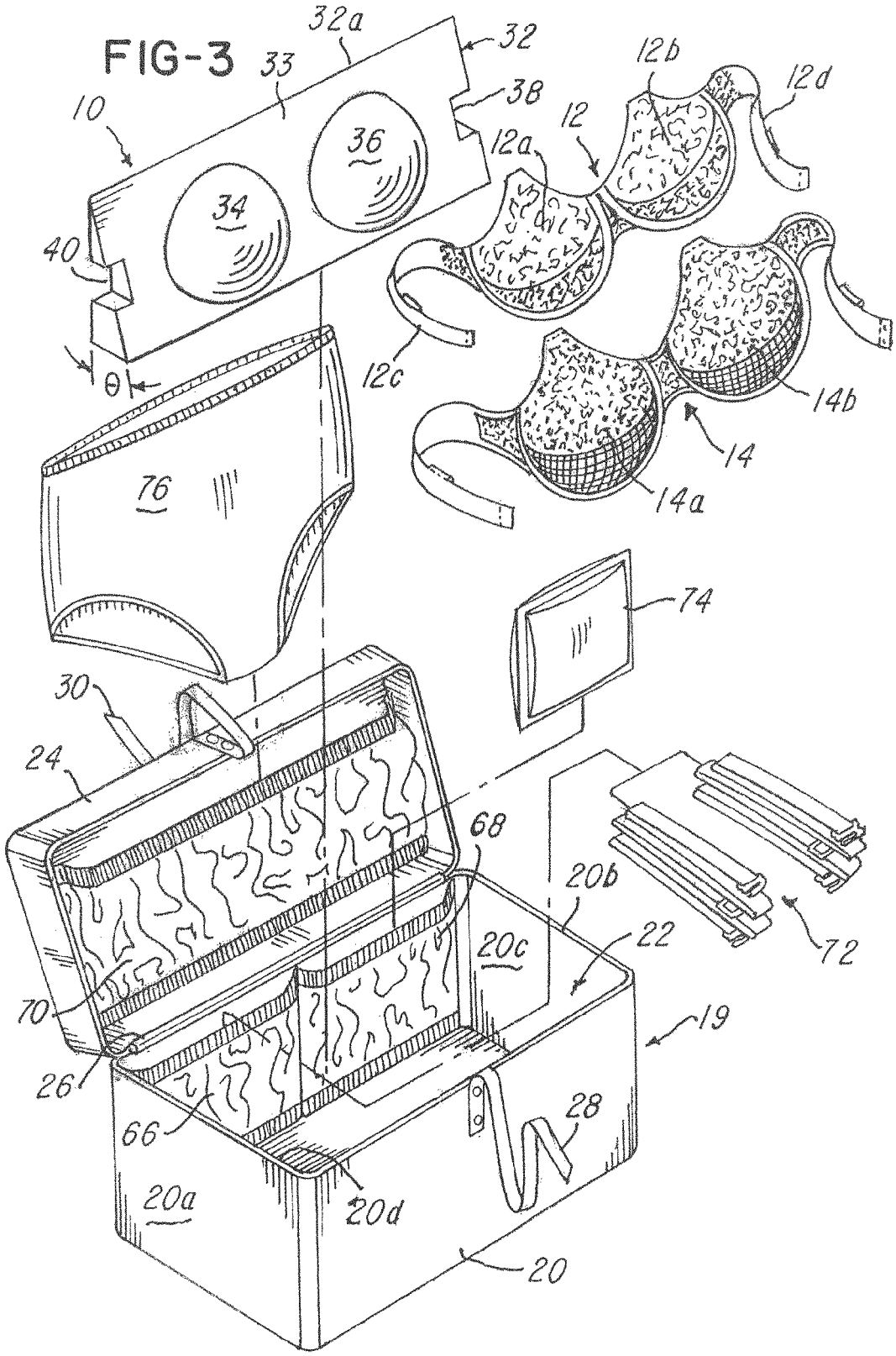
FIG. 3 is an exploded view of the embodiment shown in FIG. 2.

Referring now to FIG. 3, an exploded view of a brassiere travel carrier protector case, box, container or brassiere storage system 10 is shown. The brassiere storage system 10 is for storing a plurality of brassieres, such as brassieres 12, 14, 16 and 18 illustrated in FIGS. 2 and 3. In the examples shown, the brassieres 12-18 may be the same or they may each comprise different colors, patterns, shapes and the like. One feature of the example being illustrated is that the brassieres 12-18 are situated or positioned on a support 32 such that a user may observe at least a portion of each of the stored brassieres, 12-18 to facilitate seeing, identifying and selecting the brassiere 12-18 to be used.

The brassiere storage system 10 comprises housing 19 (FIG. 1) which may be made of any suitable sturdy material, such as a wood, metal, plastic or composite material or even a paper material, such as cardboard or even a corrugated material. A desirable feature of the housing 19 is that it does not collapse upon and crush the brassieres 12-18 stored in the area 22 in the matter described herein.

Figure 1:
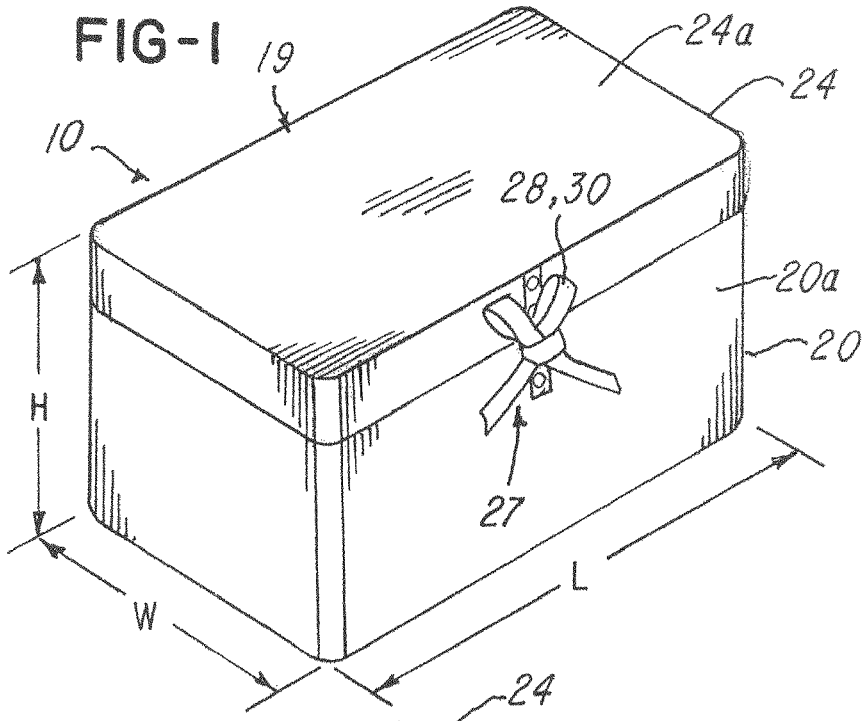
FIG. 1 is a perspective view of a brassiere travel storage container and system in accordance with one embodiment of the invention, showing brassiere container and a lid in a closed position.

The housing 19 comprises a container 20 and a lid 24 which may be separate from or hingeably attached thereto with a hinge 26 (FIG. 2) and moved from an open position, illustrated in FIGS. 2 and 3, to a closed position illustrated in FIG. 1. The container 20 and lid 24 comprise exterior surfaces of 20*a* and 24*a* of housing 19 which may comprise a decorative pattern (not shown). The surfaces 20*a*, 24*a* and interior surface 20*b* and exterior surface 20*g* may be provided or covered with cloth or padding (not shown). The container 20 may have a fastener 27, such as a clasp, buckle, strap, closure or, as illustrated, ribbons 28 and 30, which is fastened to the lid 24 and container 20. The ribbons 28 and 30 may be secured to the container 20 and lid 24 with suitable brads, rivets, screws, adhesives, staples or any other suitable means for fastening the ribbons thereto. The ribbons 28 and 30 may be tied to retain the lid 24 in the closed position.

Figure 8:
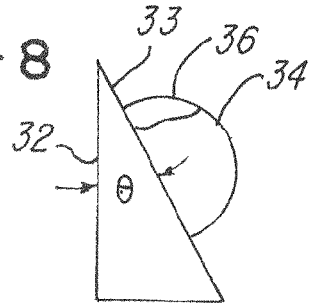
FIG. 8 is a partial fragmentary view, taken in the direction of arrow A in FIG. 5, in which a surface of the support is situated and further illustrating the angled position of the semi-spherical portions or supports 36.

The brassiere storage system 10 further comprises at least one or a plurality of supports 32 (FIG. 3) having a plurality of semi-spherical supports, areas or portions 34 and 36 projecting there from. The semi-spherical portions 34 and 36 receive and support cups, such as cups 12*a* and 12*b* of brassiere 12 and cups 14*a* and 14*b* of brassiere 14 as shown. It should be understood that the supports 32 may be molded from a plastic material, paper, composite material, Styrofoam, or provided in some other sturdy form so that it can adequately support and maintain the shape of the cups, for example, during traveling. It is desirable that when the housing 19 is placed in a suitcase (not shown) during travel or the like. As illustrated in FIGS. 3 and 8, the support 32 defines a planer surface 33 that is situated at an acute angle θ which in the illustration being described, is at least 30 degrees and in another embodiment about 35 degrees. This facilitates situating brassieres 12-18 in the inclined position illustrated in FIG. 2, which, in turn, facilitates aiding a user to view portions, of the brassieres 12-18, such as portions 16*a* and 18*a* and select a desired brassiere 12-18 to wear.

Figure 4:
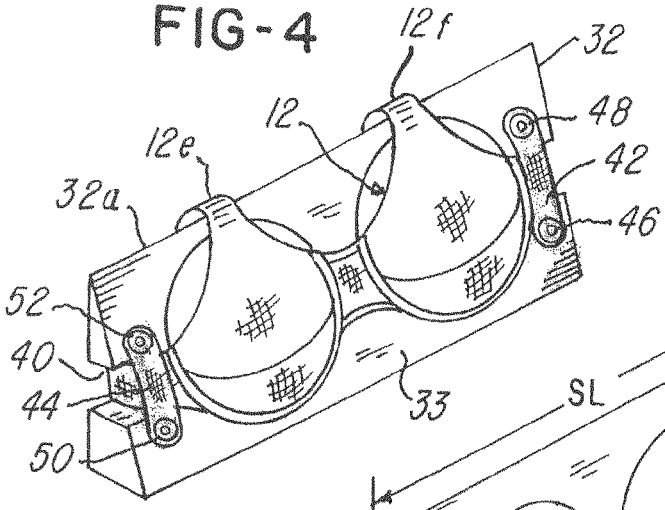
FIG. 4 is a general perspective view illustrating an embodiment with a removable support showing a brassiere supported thereon.

In the example being described, the plurality of brassieres 12, 14, 16 and 18 are placed on the support 32 as illustrated in FIGS. 2-4. Thus, note that the brassieres 12-18 are situated in a predetermined position so that the user can view at least a portion, such as the portion 18*a* of brassiere 18 and portion 16*a* of brassiere 16, as illustrated in FIG. 2. This facilitates enabling the user to see, feel and select the different brassieres 12-18 that are stored in the housing 19.

As best illustrated in FIGS. 3-7, the support 32 may comprise a plurality of notched-out areas 38 and 40 for receiving bra straps, such as straps 12*c* and 12*d* of brassiere 12 in FIG. 3. It should also be noted that the brassieres 12-18 have upper straps such as straps 12*e* and 12*f* (FIG. 4) that may be draped or placed over the top edge 32*a* of support 32 as illustrated or they may be removed and stored and described later herein. One or more securing straps 42 and 44 (FIG. 4), which are secured to the support 32 with a plurality of buttons 46, 48, 50 and 52 may be provided to retain one or more of the brassieres in a fixed position on the support 32.

Figure 5:
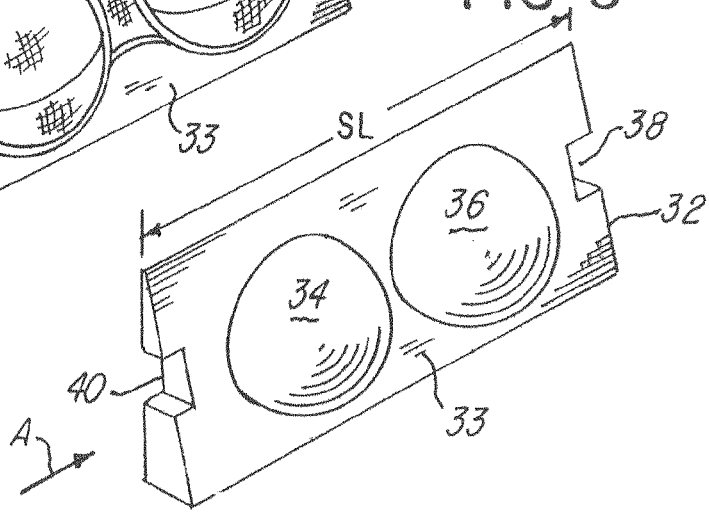
FIG. 5 is perspective view of the support, showing a plurality of semi-spherical areas, portions or supports for receiving the cups on at least one or a plurality of brassieres and further illustrating notched areas for receiving the straps of at least one or a plurality of brassieres.
Figure 6:
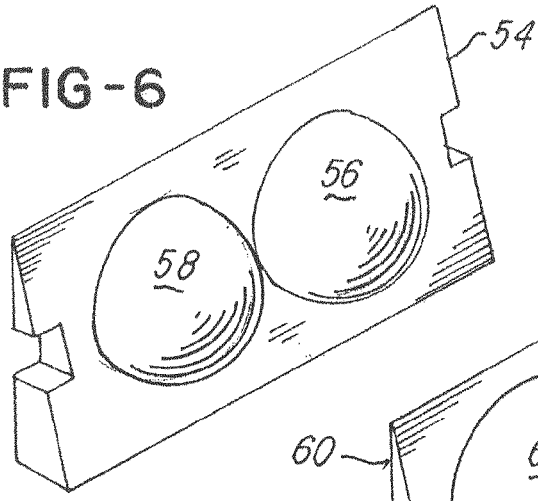
FIG. 6 is a view similar to FIG. 5 showing a support having a plurality of semi-spherical areas or supports for supporting larger cup sizes than the embodiment shown in FIG. 5.
Figure 7:
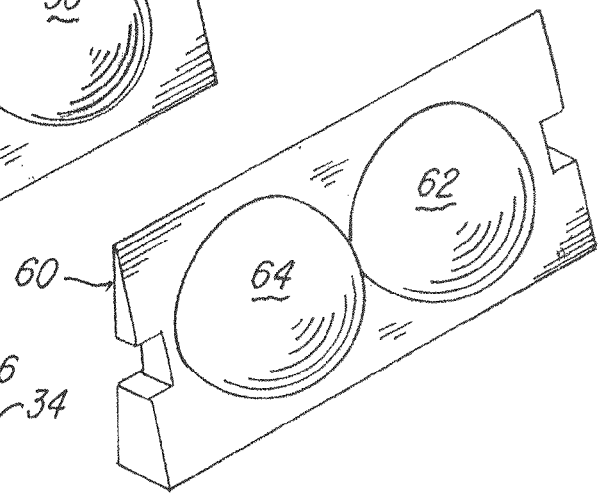
FIG. 7 is a view similar to FIGS. 5 and 6 showing a plurality of semi-spherical supports that are larger than the semi-spherical portions or supports shown in FIGS. 5 and 6.

As illustrated in FIGS. 5-7, the brassiere storage system 10 may be provided with a plurality of supports 32, each having a plurality of semi-spherical portions, supports or areas of different sizes. For example, the support 32 illustrated in FIG. 5 may comprise semi-spherical supports 34 and 36, which are adapted to receive a B-size cup of a brassiere. FIG. 6 shows another support 54 having semi-spherical areas 56 and 58 that are slightly larger in size compared to the semi-spherical areas or portions 34 and 36 illustrated in FIG. 5 and that are adapted to receive a brassiere having C-sized cups. Further, FIG. 7 illustrates still another example where a support 60 may be provided with a plurality of semi-spherical areas 62 and 64 that are adapted to receive a brassiere having E-sized cups.

Figure 9:
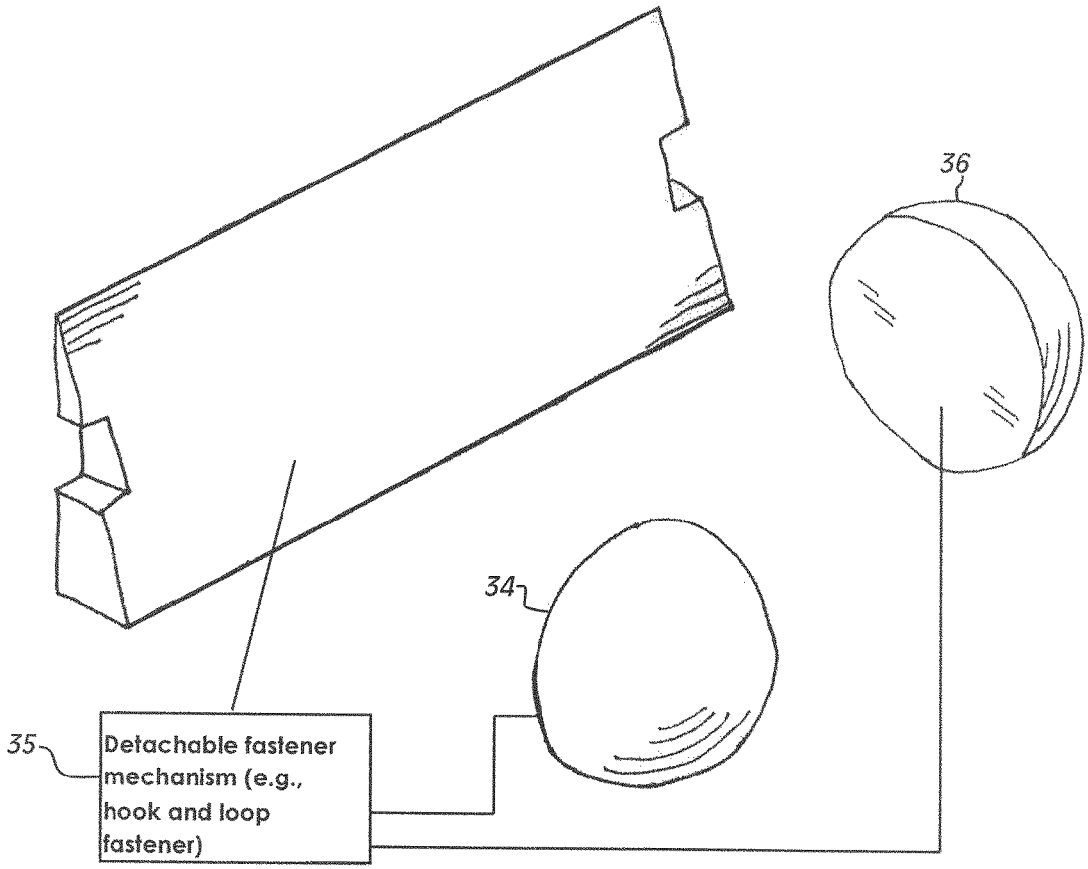
FIG. 9 is a view similar to FIG. 6 showing a support having interchangeable semi-spherical areas or supports removably attachable thereto.

Thus, it should be appreciated that the brassiere storage system 10 may be provided with a plurality of supports 32, 54 and 60, which are sized or adapted to receive different brassiere cup sizes. The semi-spherical areas 34 and 36 of support 32 may be integrally molded or formed as part of the support 32 or they may be detachable secured to support 32 with, for example, a hook and hook attachment mechanism 35 (see FIG. 9), known commercially as Velcro®, thereby enabling one or more of supports 32, 54 and 60 to be capable of receiving semi-spherical portions of different sizes. In other words, a single support base may be used and adapted for receiving a plurality of pairs of different sized semi-spherical areas that are adapted to receive brassieres 12-18 having different cup sizes.

Referring back to FIGS. 2 and 3, note that the container 20 and the lid 24 further comprise a plurality of elastic pockets 66, 68 and 70 made of cloth or other suitable material in the example being described. The pocket 66 may be adapted to receive one or more of a plurality of upper brassiere straps 72 that are removed from the brassieres 12-18, while pocket 68 may be adapted to receive an aroma or scented packet or container 74 for providing an aroma to the items stored in the container 20. This aroma or scent therapy facilitates causing the brassieres 12, 14, 16 and 18 to become scented with a predetermined aroma, scent or perfume. Note that the pocket 70 in the illustration being described is adapted to receive other items, such as undergarments 76.

The housing 19 comprises a length L (FIG. 1) of less than about 30 centimeters, a width W of less than about 20 centimeters and a height H of less than about 15 centimeters. The dimensions of the housing 19 are selected so that the housing 19 may be adapted to be received in and placed in, for example, a suitcase, drawer or simply carried separately. In this regard, a handle (not shown) may be provided on the housing 19 for easy transportation.

A method for storing at least one brassiere will now be described. First, the housing 19 having one or more of the features described earlier herein, such as the pockets 66, 68 and 70, the fasteners 27, lid 24 and container 20 are provided. As mentioned earlier, the exterior surface 20*a* of container 20 and surface 24*a* of lid 24 may be provided with a decorative pattern, padded or formed from a decorative textile material or pattern to provide an aesthetically pleasing and attractive travel protector or housing 19. The housing 19 is provided with the removable support 32 having the semi-spherical portions, such as portions 34 and 36, which may be selected by the user to accommodate the user's brassiere size. Thus, for example, if a user wears brassieres having B-sized cups, then the user would select the support 32 with B-sized semi-spherical portions 34 and 36. The semi-spherical portions 34 and 36 are mounted onto surface 33 (FIG. 8) if the brassiere storage system 10 is provided with semi-spherical supports that are detachable. As mentioned earlier, it should be appreciated that the brassiere storage system 10 may be provided with either a plurality of supports, such as supports 32, 54 and 60 illustrated in FIGS. 5-7 having integrally formed semi-spherical supports or a single support base 32 that is capable of receiving a plurality of pairs of detachable semi-spherical areas in order to give a user, such as a consumer or a merchant, the ability to store brassieres having different cup sizes.

Once the support 32 having the desired semi spherical areas 34 and 36 is selected, it is situated in container 20. The brassieres 12-18 are situated thereon, as illustrated in FIGS. 2 and 3. As mentioned earlier herein, after the support 32 is situated in the container 20 and one or more of the brassieres 12-18 situated thereon, the brassieres 12-18 are situated in a predetermined position, such as an inclined position to enable the user to view and select the desired brassiere 12-18 to wear. Again, the support 32 may be integrally molded (not shown) into the container 20 or, as mentioned earlier herein, the support 32 may be detachably removed from the container. In this regard, the support 32 may comprise a length SL-(FIG. 5) that is slightly shorter than the length L (FIG. 1) so that the support 32 may be press-fit between the walls 20*c* and 20*d* (FIG. 3).

Although not shown, the support 32, container 20, and lid 24, whether they are integrally molded as a one-piece construction or provided as separate pieces, may be provided from any suitable material that is capable of supporting the brassieres 12-18 so that they do not crush or become distorted from external pressures. For example, the container 20 and support 32 may be provided in an integral, polymer or cellulose material construction or may be provided in a Styrofoam, corrugated paper or other foam construction that is coated or vacuum sealed with an outer surface material (not shown) to provide the desired sturdiness and rigidity.

When a user desires to travel, she selects the desired brassieres that she wishes to take during her trip. The brassieres 12-18 are situated on the support 32 and the user may also store the undergarments 76, aroma 74 and straps 72 in the pockets 70, 68 and 66, respectively, as illustrated in FIG. 2. She then closes the lid 24 and ties the fastener 27, as illustrated in FIG. 1. The housing 19 may now be placed and carried separately or situated in a suitcase (not shown) during travel. When it is desired to select a brassiere 12-18, the user again opens the lid 24 to the open position shown in FIG. 2 and then views at least a portion of one or more of the brassieres 12-18. She selects the desired brassiere for the particular occasion. In this regard, it is not uncommon that she may take multiple brassieres 12-18 having different patterns or colors to choose from. For example, she may take a black brassiere in anticipation of wearing a black evening gown and a red brassiere in anticipation of wearing a red dress on another occasion.

Advantageously, this invention provides a system and method to facilitate preventing distortion, compression or other undesired reshaping of the cups of the brassieres during storage, such as during travel, and further enabling a user to quickly view, identify and select a desired brassiere 12-18 when they are situated in the container 20.

Other objects and advantages of the invention will be apparent from the following description, the accompanying drawings and the appended claims.

What is claimed is:

1. A brassiere storage system to facilitate preventing distortion of at least one first padded brassiere having a first plurality of cups and at least one second padded brassiere having a second plurality of cups during travel, said system comprising:

a container;

a first support for detachably mounting in said container, said first support comprising a first plurality of supports for supporting said first plurality of cups, respectively, to facilitate preventing distortion of said at least one first padded brassiere;

a second support being interchangeable with said first support, said second support having a second plurality of supports for receiving said second plurality of cups, respectively; said first plurality of supports comprising a first pair of semispherical areas of a first size for receiving said first plurality of cups of said at least one first padded brassiere and said second plurality of supports comprising a second pair of semispherical areas of a second size for receiving cups of said at least one second padded brassiere, said second size being different from said first size, said first plurality of supports and said second plurality of supports each engageing at least two sidewalls of said container such that a planar plane of said support that lies at an acute angle relative to a bottom of said container.

2. The brassiere storage system as recited in claim 1 wherein said first pair of semispherical areas are integrally formed with a first base to provide a one-piece first integral support and said second pair of semispherical areas being integrally formed with a second base to provide a one-piece second integral support, respectively.

3. The brassiere storage system as recited in claim 1 wherein said inclined plane lies in an angle at least 30 degrees relative to a bottom of said container.

4. The brassiere storage system as recited in claim 1 wherein said container comprises an exterior surface comprising a decorative design.

5. The brassiere storage system as recited in claim 1 wherein said system further comprises at least one aroma packet adapted to be received in said at least one of said plurality of interior pockets.

6. The brassiere storage system as recited in claim 1 wherein said container comprises a plurality of interior pockets.

7. The brassiere storage system as recited in claim 1 wherein said system further comprises at least one aroma packet adapted to be received in said container for providing aroma therapy to said at least one first or said at least one second padded brassiere.

8. The brassiere storage system as recited in claim 1 wherein said container comprises a length of less than about 30 cm, a width of less than about 20 cm and a height of less than about 15 cm.

9. The brassiere storage system as recited in claim 1 wherein each of said first plurality of supports are integrally formed into a first integral support and said second plurality of supports are integrally formed in a second integral support, respectively, each of said first and second integral supports being adapted to be press fit or mounted in said container.

10. The brassiere storage system as recited in claim 6 wherein said system further comprises a mechanism for removably securing said first and second pair of semispherical areas to said container so that a size and/or relative position of each of said first or second pair of semispherical areas may be changed.

11. The brassiere storage system as recited in claim 1 wherein each of said first and second plurality of supports is formed of a substantially rigid material that prevents said at least one first padded brassiere or said at least one second padded brassiere from distorting.

12. The brassiere storage system as recited in claim 1 wherein said inclined plane cooperates with a bottom of said container to define a predetermined angle, said predetermined angle being at least 30 degrees relative to a bottom of said container.

13. The brassiere storage system as recited in claim 1 wherein said container comprises an expandable pocket in an interior surface of either said container or said lid for receiving either an undergarment or an aroma therapy container for providing an aroma to said at least one first or second padded brassiere.

14. The brassiere storage system as recited in claim 1 wherein said first and second supports are dimensioned such that they can be press fit between opposing walls of said container.

15. The brassiere storage system as recited in claim 1 wherein said container, a lid and said first or second plurality of supports are dimensioned to be received in a suitcase.

16. The brassiere travel system as recited in claim 1 wherein said first support comprises a base and further comprises a fastener for detachably fastening said first and second pairs of semispherical areas to said base.

17. The brassiere travel system as recited in claim 16 wherein said fastener for detachably fastening comprises a hook and loop fastener.

18. A brassiere storage system for storing a plurality of brassieres, each of said plurality of brassieres comprising a plurality of padded cups, said brassiere storage system comprising:

a container;

a lid for closing said container; and a support situated in said container and adapted to receive said plurality of padded cups at an acute angle so that said plurality of padded cups do not become crushed, deformed or distorted during travel and carrying, said plurality of brassieres becoming inclined after they are received on said support so that a user may view and select at least one of said plurality of brassieres, wherein said support comprises a plurality of raised areas raised for receiving said first or second plurality of padded cups, respectively;

said support engages at least two sidewalls of said container such that a planar plane of said support lying at said acute angle relative to a bottom of said container and cooperating with said container and said lid to protect said plurality of brassieres from distorting.

19. The brassiere storage system as recited in claim 18 wherein said plurality of brassieres comprises a first brassiere and a second brassiere, said support being removable from a container, said brassiere storage system further comprising:

a second support for interchanging with said support;

said support and said second support comprising integral raised portions that define a first pair of semispherical areas adapted to receive and support curs of said first brassiere and a second pair of semispherical areas, respectively, adapted to receive and support cups of said second brassiere, for supporting a cup or cups of a brassiere, where said integral raised portions of said support are different sizes than said integral raised portions of said second support.

20. The brassiere storage system as recited in claim 18 wherein said support is removable from said container.

21. The brassiere storage system as recited in claim 18 wherein said support is integrally formed in said container.

22. The brassiere storage system as recited in claim 21 wherein said container and said support are integrally formed of plastic.

23. The brassiere storage system as recited in claim 18 wherein said system further comprising at least one other support having a pair of semispherical areas for receiving and supporting cups of at least one second brassiere.

24. The brassiere storage system recited in claim 18 wherein said container comprises an exterior surface comprising a decorative design.

25. The brassiere storage system recited in claim 18 wherein said container comprises a plurality of interior pockets.

26. The brassiere storage system as recited in claim 25 wherein said plurality of interior pockets are adapted to receive at least one of an aroma packet or an undergarment.

27. The brassiere storage system as recited in claim 18 wherein said system further comprises at least one aroma packet adapted to be received in said container for providing aroma therapy to said at least one first or second padded brassiere.

28. The brassiere storage system as recited in claim 18 wherein an assemblage of said container and said lid comprise a length of less than about 30 cm, a width of less than about 20 cm and a height of less than about 15 cm.

29. The brassiere storage system as recited in claim 1 wherein said container and said first or second plurality of supports comprise a hook and loop mechanism for permitting said first or second plurality of supports to be removably secured to said container.

30. The brassiere travel system as recited in claim 18 wherein said plurality of raised areas are semispherical.

* * * * *

UNITED STATES PATENT AND TRADEMARK OFFICE

CERTIFICATE OF CORRECTION

PATENT NO. : 7,516,840 B2
APPLICATION NO. : 10/971291
DATED : April 14, 2009
INVENTOR(S) : Alexis Lynn Troha et al.

It is certified that error appears in the above-identified patent and that said Letters Patent is hereby corrected as shown below:

Title Page, item [57] in the Abstract line 10, after the word suitcase delete “an” and insert --and-- therefor.

Figure 10:
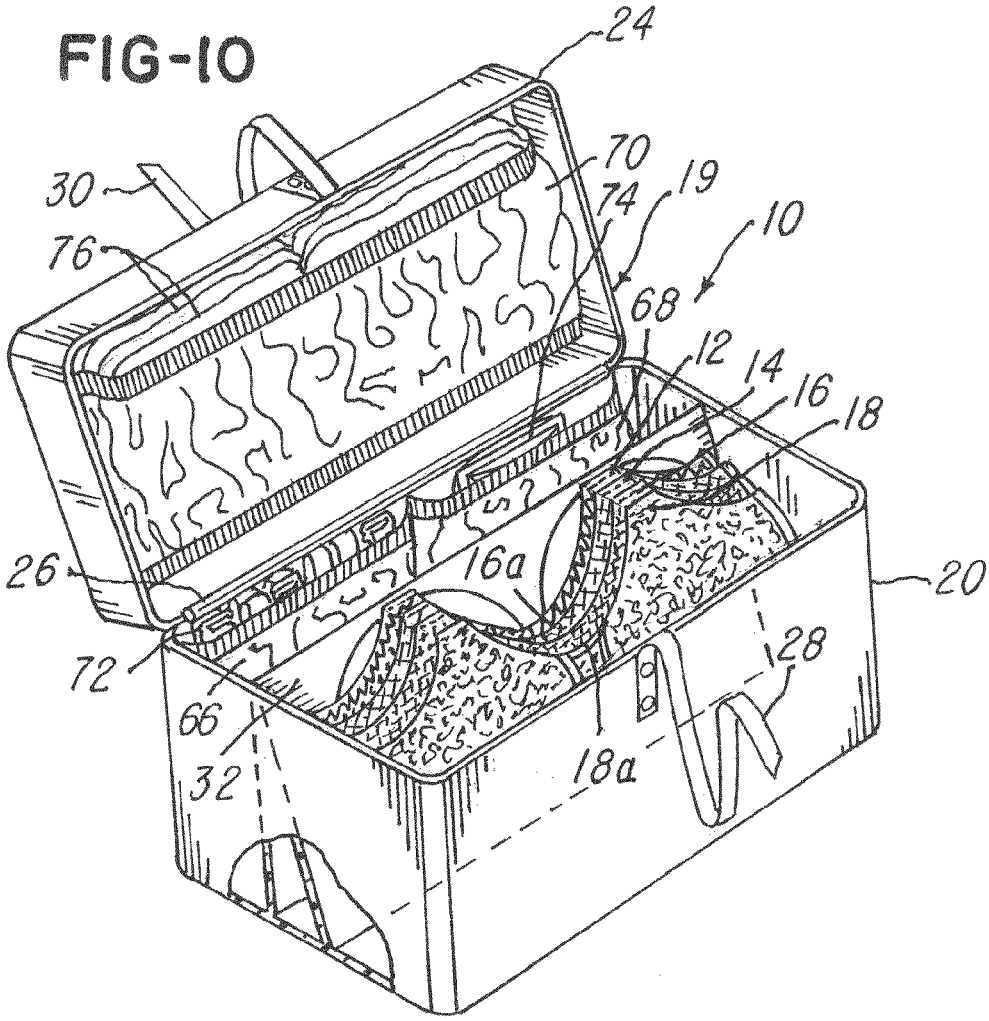

In Drawing Sheet 5, please delete drawing Fig. 10.

In Column 1, Line 24, after the word reference please insert --.--.

In Column 4, Line 22, please delete “detachable” and insert --detachably-- therefor.

In Column 4, Line 23, please delete “hook attachment” and insert --loop fastener-- therefor.

In Column 5, Line 10, please delete “semi spherical” and insert --semi-spherical-- therefor.

In Column 6, Line 37, please delete “1” and insert --6-- therefor.

In Column 6, Line 59, please delete “6” and insert --1-- therefor.

In Column 8, Line 6, please delete “curs” and insert --cups-- therefor.

Signed and Sealed this

Fourteenth Day of July, 2009

John Doll

JOHN DOLL
*Acting Director of the United States Patent and Trademark Office*